US007278410B2

(12) United States Patent
Hoke et al.

(10) Patent No.: US 7,278,410 B2
(45) Date of Patent: Oct. 9, 2007

(54) HYDROCARBON ADSORPTION TRAP FOR CONTROLLING EVAPORATIVE EMISSIONS FROM EGR VALVES

(75) Inventors: Jeffrey Barmont Hoke, North Brunswick, NJ (US); Mark Thomas Buelow, Phillipsburg, NJ (US); John Joseph Kauffman, Hazlet, NJ (US)

(73) Assignee: Engelhard Corporation, Iselin, NJ (US)

( * ) Notice: Subject to any disclaimer, the term of this patent is extended or adjusted under 35 U.S.C. 154(b) by 0 days.

(21) Appl. No.: 11/281,662

(22) Filed: Nov. 17, 2005

(65) Prior Publication Data

US 2007/0107705 A1 May 17, 2007

(51) Int. Cl.
*F02M 25/07* (2006.01)
*F02B 47/08* (2006.01)

(52) U.S. Cl. ..... 123/568.11; 123/568.29

(58) Field of Classification Search ..... 123/568.11, 123/568.12, 568.17, 568.18, 568.21, 358.26, 123/568.29, 188.14, 668–670; 60/278, 279; 422/177, 180; 423/213.2
See application file for complete search history.

(56) References Cited

U.S. PATENT DOCUMENTS 4,027,367 A 6/1977 Rondeau
4,090,482 A 5/1978 Yoshida
4,106,449 A * 8/1978 Matsumoto et al. ... 123/568.12
4,497,335 A * 2/1985 Masuda ..... 123/568.29
4,985,210 A 1/1991 Minami
5,051,244 A 9/1991 Dunne et al.
5,094,218 A 3/1992 Everingham et al.
5,125,231 A 6/1992 Patil et al.
5,158,753 A 10/1992 Take et al.
5,241,940 A 9/1993 Gates, Jr.
5,744,103 A * 4/1998 Yamada et al. ..... 422/177
5,771,869 A 6/1998 Yoshihara et al.
5,785,030 A 7/1998 Paas
5,897,846 A * 4/1999 Kharas et al. ..... 423/213.2
6,171,556 B1 1/2001 Burk et al.
6,209,317 B1 4/2001 Hirota
6,390,078 B1 5/2002 Gee et al.
6,432,179 B1 8/2002 Lobovsky et al.
6,474,319 B1 * 11/2002 Hough et al. ..... 123/568.11
6,543,427 B2 4/2003 Kawasaki (Continued)

FOREIGN PATENT DOCUMENTS

CN 1059701 A 3/1992

(Continued)

OTHER PUBLICATIONS

Society of Automotive Engineers Publication No. 920847 Heimrich, et al., "Cold-Start Hydrocarbon Collection for Advanced Exhaust Emission Control", Feb. 24-28, 1992.

(Continued)

*Primary Examiner*—Willis R. Wolfe, Jr.
(74) *Attorney, Agent, or Firm*—Frenkel & Associates, P.C.; Melanie Brown; Richard Negin

(57) ABSTRACT

The present invention is directed to the use of an improved hydrocarbon adsorbent coating for the treatment of exhaust emissions from a motor vehicle. More specifically, the hydrocarbon adsorbent of the present invention can be coated to any surface area of an exhaust gas recirculation system to trap hydrocarbon vapors before they can be released to the atmosphere.

20 Claims, 3 Drawing Sheets

U.S. PATENT DOCUMENTS

| | | | | |
|---|---|---|---|---|
| 6,644,622 | B2 * | 11/2003 | Modien | 251/129.15 |
| 6,715,475 | B2 * | 4/2004 | Cook | 123/568.21 |
| 6,792,749 | B2 | 9/2004 | Ueno et al. | |
| 6,863,984 | B2 | 3/2005 | Hoke et al. | |
| 2002/0029693 | A1 | 3/2002 | Sakakibara et al. | |
| 2003/0192512 | A1 | 10/2003 | Luley et al. | |
| 2003/0234012 | A1 * | 12/2003 | Bosteels | 123/670 |
| 2004/0226440 | A1 | 11/2004 | Foong et al. | |

FOREIGN PATENT DOCUMENTS

| | | | |
|---|---|---|---|
| JP | 09192440 A | * | 7/1997 |

OTHER PUBLICATIONS

U.S. Appl. No. 11/282,814, Hoke et al., "Hydrocarbon Adsorption Method and Device for Controlling Evaporative Emissions from the Fuel Storage System of Motor Vehicles", Nov. 18, 2005.

U.S. Appl. No. 11/281,349, Buelow, et al., "Hydrocarbon Adsoprtion Filter for Air Intake System Evaporative Emission Control", Nov. 17, 2005.

U.S. Appl. No. 11/281,629, Hoke et al., "Improved Hydrocarbon Adsorption Slurry Washcoat Formulation for Use at Low Temperature", Nov. 17, 2005.

English language Abstract for CN 1059701A, Kuixi et al., "High Silicon Beta Zeolite", Mar. 25, 1992.

* cited by examiner

HYDROCARBON ADSORPTION TRAP FOR CONTROLLING EVAPORATIVE EMISSIONS FROM EGR VALVES

FIELD OF THE INVENTION

This invention is directed to the use of a hydrocarbon adsorbent coating for controlling evaporative emissions from vehicles. In particular, this invention relates to the use of a hydrocarbon adsorbent coating, which can be applied to one or more surfaces of an exhaust gas recirculation system of a motor vehicle, to reduce the release of hydrocarbon emissions into the atmosphere.

BACKGROUND OF THE INVENTION

There continues to be a push to reduce emissions from internal combustion engines. One manner in which emissions are generated from an internal combustion engine is when the engine is shut off. Fuel which has been released from fuel injectors, but has not been consumed prior to engine shut down, may evaporate outwardly through the intake manifold, intake air ducts, air filter, or components of the exhaust system and exhaust gas recirculation (EGR) system, thereby escaping into the atmosphere and contribute to air pollution.

Evaporative emission regulations for vehicles require the control of polluting substances (primarily hydrocarbons) from the vehicle as it sits unused. Evaporative emissions can leak out of a vehicle from many sources including the air intake system, fuel tank, and exhaust gas recirculation (EGR) system. In the past, only those from the fuel tank were captured, with carbon-filled canisters. However, with increasing emission regulations it has become necessary to expand evaporative emission capture technology to other vehicle components such as the EGR valve system and air intake system. Evaporative emissions need to be retained within the air inlet system until the powertrain is again used at which time the retention system will give up the harmful substances to be consumed and controlled through the normal exhaust emission control systems.

There are several ways to control the outward flow of pollutants from the air intake system of an automobile. One such technique is the careful shaping of the ducting and filter box. However, this method is often not sufficient to meet the regulatory requirements. Accordingly, other methods must be used such as the incorporation of systems in the air intake system that use some form of carbon or other material to absorb the pollutants during the rest cycle. When the vehicle is next started, the in-rushing air will draw the pollutants from the absorbent and direct the pollutants into the engine and/or through the normal exhaust system pollution controls. This inward air rush also regenerates the absorption systems so that they may be reused. Unfortunately, these extra absorption systems add cost, weight and complexity to a vehicle and often restrict the air flow.

In additional efforts to reduce these types of inadvertent evaporative emissions, many types of filters have been developed. Examples of filters for use in the intake system of a vehicle are found in U.S. Pat. No. 6,432,179 to Lobovsky et al. and U.S. Patent Application Publication No. U.S. 2002/0029693 to Sakakibara et al., both of which are incorporated herein by reference. The publication of Sakakibara et al. discloses several embodiments of hydrocarbon adsorbing devices having a case surrounding an inner cylinder portion. A hydrocarbon adsorbent material is provided in a chamber defined by the case and the inner cylinder portion. The inner cylinder portion has a central bore that extends through its length to permit induction air to pass therethrough, and also has windows that allow any hydrocarbons in the induction system to pass through a filter surrounding the inner cylinder portion to the hydrocarbon adsorbent material in the chamber to be adsorbed thereby.

As previously described, when the engine is not operating, fuel-based hydrocarbon emissions can diffuse back from the engine through the air intake, air induction system, exhaust system, or exhaust gas recirculation system and out to the ambient atmosphere. Some sources for these fuel-based hydrocarbon emissions include the fuel injectors, intake manifold walls, cylinders, positive crankcase ventilation system, and EGR valve.

In general, control of air intake system fugitive hydrocarbon emissions can be accomplished by placing a hydrocarbon adsorber unit within the air induction system between the ambient environment and the engine (e.g., before the throttle body). When the engine is not operating, hydrocarbon vapors that diffuse back though the air induction system will be trapped by the adsorber and not released to the ambient atmosphere. During subsequent operation of the vehicle, any hydrocarbons trapped on the adsorber unit will be desorbed and pulled into the engine where they are combusted. Devices for adsorbing hydrocarbon vapors within a vehicle's air intake system are well known in the art and include extruded carbon monoliths, carbon impregnated cloth, carbon impregnated polyurethane, and granular carbon (configured in a thin layer). These devices are usually located within the air cleaner box or air induction tube.

Furthermore, systems and methods for adsorbing uncombusted hydrocarbons in the exhaust gas stream of an automobile are also well known. These systems and methods are particularly useful for adsorbing uncombusted hydrocarbons emitted during the cold start of the automobile engine.

For example, U.S. Pat. No. 4,985,210 is directed to an exhaust gas purifying apparatus for an automobile employing a three-way catalyst with either a Y-type zeolite or a mordenite used in a hydrocarbon trap upstream of the three-way catalyst. In the embodiment of FIG. 2 of U.S. Pat. No. 4,985,210, a bed of activated carbon is disposed upstream of an adsorbent zone. A solenoid-operated valve mechanism serves to direct the exhaust gas stream either through or around the activated carbon bed, depending on the temperature of the exhaust gas stream, and then through the adsorbent zone and the three-way catalyst.

U.S. Pat. No. 5,051,244 is directed to a process for treating an engine exhaust gas stream in which the gas stream is directed through a molecular sieve in an adsorbent zone during the cold-start phase of engine operation. When the hydrocarbons begin to desorb, the adsorbent zone is by-passed until the catalyst is at its operating temperature, at which point the gas stream is again flowed through the adsorbent zone to desorb hydrocarbons and carry them to the catalyst zone. A paper by M. Heimrich, L. Smith and J. Kotowski entitled Cold-Start Hydrocarbon Collection for Advanced Exhaust Emission Control, SAE Publication Number 920847, discloses an apparatus which functions in a manner similar to that of U.S. Pat. No. 5,051,244.

U.S. Pat. No. 5,125,231 discloses an engine exhaust system for reducing hydrocarbon emissions, including the use of beta zeolites as hydrocarbon adsorbents. Zeolites having a silica/alumina ratio in the range of 70/1 to 200/1 are preferred adsorbents. The apparatus includes by-pass lines and valves to direct exhaust gases from a first converter directly to a second converter during cold-start operation and when the first converter reaches its light-off temperature, to either by-pass the second converter or recycle effluent from it to the first converter.

U.S. Pat. No. 5,158,753 discloses an exhaust gas purifying device comprising: a catalyst device installed in the exhaust gas path of an internal combustion engine for treating the exhaust gas of the engine; an adsorbing device installed in the exhaust gas path between the catalyst device and the internal combustion engine, for treating the exhaust gas of the engine. One embodiment includes a heat exchanger for performing heat transfer between the exhaust gas flowing from the internal combustion engine to the adsorbing device and the exhaust gas flowing from the adsorbing device to the catalyst device. Alternatively, the catalyst device includes a catalyst secured in the low-temperature-side gas flow path of a heat exchanger, and the exhaust gas flowing from the internal combustion engine to the adsorbing device is allowed to flow to the high-temperature-side gas flow path of the heat exchanger.

U.S. Pat. No. 6,171,556 discloses a method and apparatus for treating an exhaust gas stream containing hydrocarbons and other pollutants. The method comprises the steps of flowing the exhaust gas stream through a catalytic member comprising a monolith body having a first catalyst zone and a second catalyst zone therein to contact a catalyst in a first catalyst zone to convert at least some of the pollutants in the exhaust gas stream into innocuous products. The exhaust gas stream is then discharged from the catalytic member and flowed through an adsorbent zone to adsorb at least some of the hydrocarbon pollutants with an adsorbent composition. The exhaust gas stream is discharged from the adsorbent zone and flowed to the second catalyst zone to convert at least some of the pollutants into innocuous products. The exhaust gas stream, so treated, is then discharged to the atmosphere through suitable discharge means. A preferred adsorbent is a zeolite, having a relatively high silica to alumina ratio and a low relative Bronsted acidity. The preferred adsorbent compositions comprise beta zeolites.

It is also known in the art to provide an automobile internal combustion engine with an exhaust gas recirculation (EGR) system for the circulation of a flow of exhaust gases from the engine back to the engine. The recirculation of exhaust gas back to the engine cools the engine, and thereby, limits the formation of nitrogen oxides (NOx) in the engine (exhaust gas). The EGR system contains an EGR valve, which can be opened or closed to varying degrees, to control the flow of engine exhaust gases through the exhaust gas recirculation system. Since the EGR valve is connected to the air intake system and is vented for pressure relief, the EGR valve can be an additional route for release of hydrocarbons to the atmosphere while the vehicle engine is not in operation. Due to the large size, the prior art hydrocarbon adsorber units, described above, cannot be included in or added to the EGR valve. Therefore, it is an object of the present invention to provide a means of controlling evaporative hydrocarbon emissions from the EGR valve.

As discussed above, zeolites are often used as coatings on monolithic substrates for various high temperature adsorption and catalytic applications. In these cases, inorganic binder systems are used that survive exposure to high temperatures (e.g., >500° C.) and provide good coating adhesion. However, for low temperature application (e.g., <500° C.), inorganic type binders are often not suitable since their binding characteristics are severely diminished. In these low temperature applications, organic polymer binders are ideal since they are structurally stable and provide excellent coating adhesion.

For example, commonly assigned U.S. Patent Publication No. 2004/0226440 discloses a hydrocarbon adsorption unit. The unit is positioned in the air intake system and has an air intake and air outlet. According to the application the adsorber material may be silica gel, a molecular sieve and/or activated carbon and contains an organic polymer binder, as well as an anionic, nonionic or cationic dispersant, that will cause the material to adhere to the surface of a substrate.

However, without proper choice of these stabilizing agents, interparticle agglomeration of zeolite particles or coagulation of zeolite and binder particles will occur, thus rendering the slurry unstable for coating application. As a result, a zeolite-based coating formulation must be developed that not only has good adhesion (particularly to metal substrates) at low temperature, but also excellent adsorption characteristics.

Therefore, it is an objective of the present invention to provide an improved exhaust gas recirculation system for controlling exhaust gas emissions from a motor vehicle's exhaust gas recirculation (EGR) system. It is another objective of the present invention to provide a hydrocarbon adsorbent slurry coating to an EGR valve to reduce hydrocarbon vapors from the exhaust gas, thereby preventing release of hydrocarbons into the ambient atmosphere. A key advantage to this invention is that existing components of the EGR valve can be coated with adsorbent without the need for significant valve redesign.

SUMMARY OF THE INVENTION

An exhaust gas recirculation (EGR) system is provided in a motor vehicle, which contains an EGR valve coated with a hydrocarbon adsorbent to trap hydrocarbon vapors, thereby preventing release of hydrocarbons into the atmosphere. The exhaust gas recirculation (EGR) system of the present invention comprises an air intake manifold, an air intake line, an exhaust line, an exhaust gas recirculation line, and an EGR valve. Exhaust gas, which typically contain hydrocarbon vapors, such as volatile organic compound (VOCs), may bleed from multiple components of the exhaust gas recirculation system, in particular, from the EGR valve. Additionally, the EGR valve can be an additional route for release of air intake hydrocarbons while the vehicle is not in operation. The hydrocarbon adsorbent of the present invention can be coated to one or more surfaces of an EGR valve to trap or adsorb hydrocarbons from exhaust gases, which travel through the exhaust gas recirculation system, thereby reducing the amount of hydrocarbons released into the atmosphere.

BRIEF DESCRIPTION OF THE DRAWINGS

The present invention will become more fully understood from the detailed description and the accompanying drawings, wherein.

DETAILED DESCRIPTION OF THE INVENTION

The present invention is directed to the use of a hydrocarbon adsorbent coating, which can be applied to one or more surfaces of an exhaust gas recirculation (EGR) valve. In general, the hydrocarbon adsorbent of the present invention can be coated to any surface area of the EGR valve, which may come into contact with exhaust gases or other hydrocarbon pollutants. Typically, the inner surfaces of an EGR valve are exposed to exhaust gases containing hydrocarbons and/or hydrocarbon pollutants from the air intake, thus, making these surfaces ideal for application of an adsorbent coating to trap hydrocarbons before they can be released to the ambient atmosphere.

Figure 1:
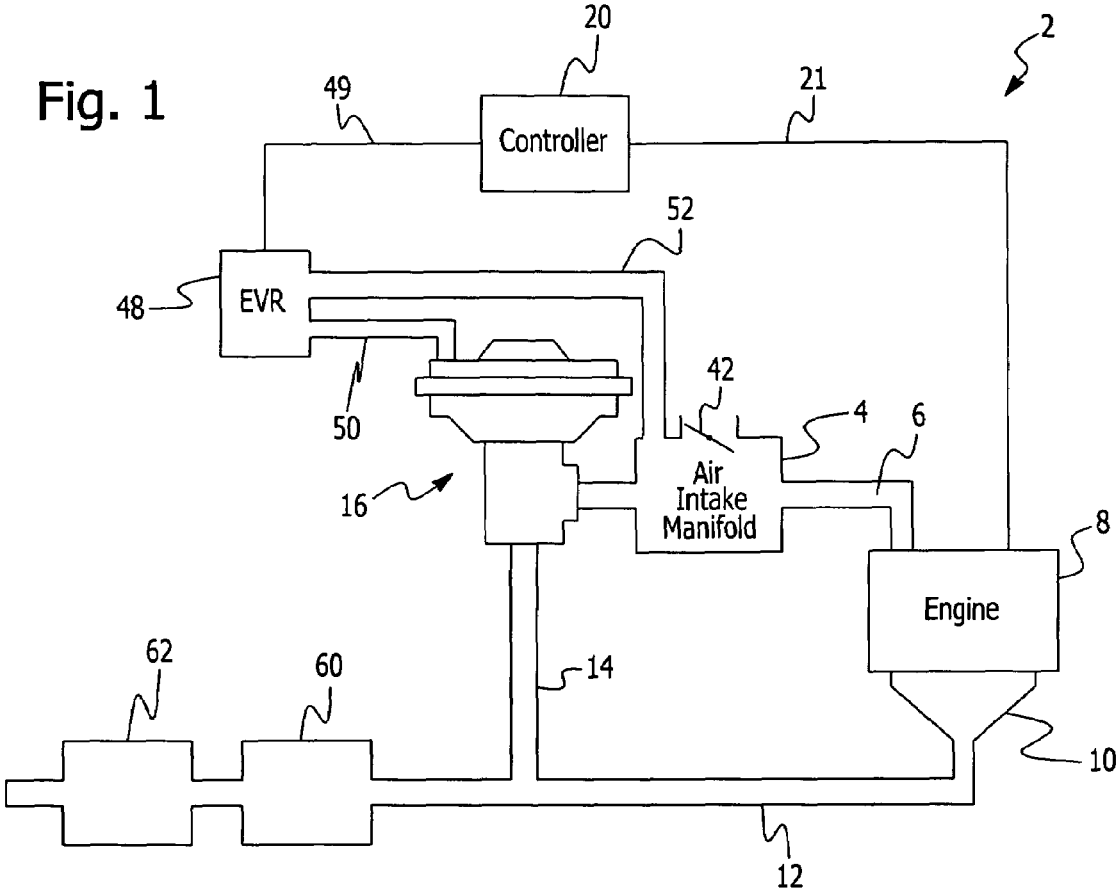
FIG. 1 is a functional block diagram of an exhaust gas recirculation (EGR) system of a motor vehicle, in accordance with an embodiment of the present invention.

Referring now to FIG. 1, an exhaust gas recirculation (EGR) system 2 in a motor vehicle is illustrated and represents one non-limiting embodiment of the present invention. The exhaust gas recirculation system 2 comprises an air intake manifold 4, an air intake line 6, an internal combustion engine 8, an exhaust manifold 10, an exhaust gas line 12, an exhaust gas recirculation line 14, and an EGR valve 16. The exhaust gas line 12 further comprises a catalytic converter 60, typically a three-way catalytic converter for the treatment of exhaust gases and a muffler 62.

The engine 8 is preferably an internal combustion engine that is controlled by a controller 20, via signal line 21. The engine 8 typically burns gasoline, ethanol and other volatile hydrocarbon-based fuels. The controller 20 may be a separate controller or may form part of an engine control module (ECM), a powertrain control module (PCM) or any other vehicle controller.

During engine operation, air is taken into the engine 8 via the air intake manifold 4. A throttle valve 42 is rotatively mounted in the air intake manifold 4 for controlling air intake flow in a known manner. The air is then circulated to the engine 8 via the air intake line 6, and injected into the combustion chamber along with fuel from the fuel tank (not shown). Controller 20, via signal line 21, manages the timing and operation of the air and fuel injectors, thereby controlling fuel combustion in the combustion chamber (not shown).

After combustion, exhaust gases are emitted from the combustion chamber and discharged into the exhaust manifold 10. The exhaust gases are then circulated through the exhaust gas line 12 to a three-way catalytic converter 60 for treatment of the exhaust gases, and subsequently released from the muffler 62 into the ambient atmosphere. Alternatively, the exhaust gases can be circulated to the EGR valve 16 through exhaust gas recirculation line 14, when the EGR valve 16 is in the open position. The recirculation of exhaust gases, which are mixed with incoming air in the air intake manifold, allow for a reduction in peak combustion temperatures, thereby reducing the formation of NOx.

Figure 2:
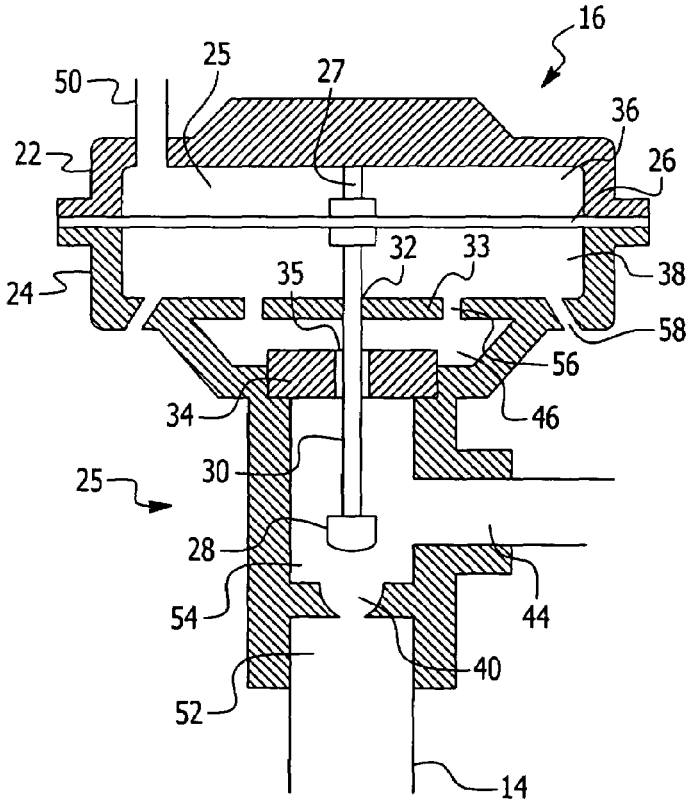
FIG. 2 is an enlarged cross-sectional view of the EGR valve in FIG. 1.

Referring now to FIG. 2, the EGR valve 16 comprises an upper casing 22, or cap, and a lower casing 24, or body, aligned juxtaposed to each other. Together the upper 22 and lower 24 casings, respectively, define an interior chamber 25, which is divided by a diaphragm 26, arranged across the interior of the EGR valve 16, into an EGR upper chamber 36 and an EGR middle chamber 38. The lower casing 24 further defines an EGR lower chamber 46 and an extended portion, which extends downward from the lower chamber 46. The extended portion of the lower casing 24, defines an EGR exhaust inlet 52, an EGR exhaust gas chamber 54, and an EGR exhaust outlet 44.

The upper surface of diaphragm 26 is connected to a spring 27 and the lower surface of diaphragm 26 is connected to a valve member 28 via a valve stem 30. The valve stem 30 is supported by the lower casing 24, through an opening 32 in shelf 33 in the lower casing 24 at the bottom of the EGR middle chamber 38, as well as a hole 35 in a valve guide 34, which is also supported by the lower casing 24. The valve stem 30 is movable within the EGR middle chamber 38, the lower chamber 46, and the EGR exhaust gas chamber 54. The movement of the valve stem 30 allows for the seating or unseating of the valve member 28 on a valve seat 40, as described in more detail below.

Operation of EGR valve 16 can be described by referring to FIGS. 1 and 2. The amount of exhaust gas returned from the exhaust gas recirculation line 14 to the air intake manifold 4, via EGR valve 16, can be controlled by controlling the degree of opening of the EGR valve 16. The valve member 28, which can be pushed downwardly or pulled upwardly by valve stem 30, is arranged so as to face a valve seat 40 formed in the extended portion 25 of the lower casing 24. When the valve member 28 is pushed all the way down, the valve member 28 sits firmly on the valve seat 40, and the EGR valve 16 is closed. When the valve member is pulled up, the valve member 28 is unseated from the valve seat 40, and the EGR valve 16 is opened. The valve member 28 can be opened or closed in varying degrees, by controlling the vacuum level in the EGR upper chamber 36, thereby controlling the amount of exhaust gas allowed to pass through the EGR valve 16 from the exhaust gas recirculation line 14 to the air intake manifold 4.

The vacuum for actuating the EGR valve 16 is controlled by an electronic vacuum regulator (EVR) 48, which controls the flow of an air source into or out of the EGR upper chamber 36 from vacuum line 50 tapped from the intake manifold 4, via vacuum intake line 52, as shown in FIG. 1. The electronic vacuum regulator 48 can inject air into the EGR upper chamber 36 creating additional air pressure in the upper chamber 36, and thus, pushing the diaphragm 26, valve stem 30, and valve member 28 down, seating the valve member 28 on the valve seat 40, to close the EGR valve 16. Alternatively, the electronic vacuum regulator 48 can vent or suck air from the EGR upper chamber 36 creating a vacuum therein, and thus, pulling the diaphragm 26, valve stem 30, and valve member 28 up from valve seat 40 to open the EGR valve 16. Controller 20, via signal line 49, manages the timing and operation of the electronic vacuum regulator 48, and thus, the opening and closing of EGR valve 16.

When the EGR valve 16 is opened by the electronic vacuum regulator 48, as described above, exhaust gases can flow through the exhaust gas recirculation line 14, through the EGR exhaust inlet 52 and valve seat 40, and into EGR exhaust chamber 54. The exhaust gas can then be expelled from the EGR valve 16, into the air intake manifold 4, through EGR exhaust outlet 44, and recirculated back to engine 8, where the hydrocarbons can subsequently be combusted in the combustion chamber.

As previously mentioned, pollutants (e.g., hydrocarbons) may leak from the EGR valve 16 and be released into the atmosphere untreated. For example, exhaust gases can leak from the EGR exhaust chamber 54, through the hole in the valve guide 34, through the EGR lower chamber 46, and through a first set of pressure release orifices 56, located between the EGR lower 46 and middle 38 chambers, respectively, and into the EGR middle chamber 38. From there, the hydrocarbons may leak into the ambient atmosphere through a second set of pressure release orifices 58, located in the lower casing 24, or potentially through the diaphragm 26. Therefore, in accordance with the present invention a hydrocarbon adsorbent material is coated onto one or more surfaces of the exhaust gas recirculation system to treat exhaust gases prior to being released to the ambient atmosphere. In general, the hydrocarbon adsorbent material may be coated to any surface of the exhaust gas recirculation valve 16, e.g., one or more inner surfaces of the EGR valve 16, for the adsorption of hydrocarbons from exhaust gases prior to release into the ambient atmosphere. As previously mentioned, preferred surfaces include any inner surface of the EGR valve, including but not limited to, the upper or lower surface of the diaphragm 26, the inner surfaces of the EGR upper chamber 36, the EGR middle chamber 38, the EGR lower chamber 46, the EGR exhaust chamber 54, the EGR inlet 52, the EGR outlet 44, and the outer surface of the valve member 28 or valve stem 30.

In another embodiment, the hydrocarbon adsorbent of the present invention may be coated onto a substrate and the substrate placed into the EGR valve, e.g., within an interior chamber of the EGR valve. In general, any substrate capable of being coated with a hydrocarbon adsorbent, and placed within an interior chamber of an EGR valve can be used. For example, the substrate may a screen, sheet, mesh or foil.

The substrate can be metallic, polymeric, ceramic, etc. Preferred metals include stainless steel alloys, e.g., 304 and 316 stainless steels, Fe—Cr—Al alloy, titanium, or aluminum. Preferred polymeric substrates include nylon, polypropylene, PVC, ABS, or polyethylene. The substrate must be able to withstand the automotive underhood environment. Accordingly, metal substrates are preferred and nylon is preferred over other polymeric substrates.

In one embodiment, the substrate is a foraminous sheet (e.g., a disk shaped screen) coated with a hydrocarbon adsorbent coating. The screen can be woven or non-woven with woven preferred. A woven screen provides uniform openings, which result in uniform airflow without channeling. The screen can be welded at the wire junction or non-welded. The choice of screen geometry has to be considered. Typically, the screen is a wire mesh, which has a tight weave with small openings in order to increase the likelihood that hydrocarbon molecules will contact the coated wires as the hydrocarbons diffuse through the screen. However, it is also desirable to have large enough openings to reduce air flow restriction to a minimum during operation of the EGR valve. Thus, for example, the wire diameter can be from about 0.01 to about 0.07 inch, preferably about 0.02 to about 0.035 inch, more preferably about 0.028 inch, with a mesh size from about 4 by 4 to about 100 by 100 wires per linear inch, preferably from about 8 by 8 to about 20 by 20 wires per linear inch, more preferably about 12 by 12 wires per linear inch. Typically, the hydrocarbon adsorbent will be disposed on the substrate in a loading of about 0.1 to about 1 g/in$^2$, more preferably from about 0.1 to about 0.4 g/in$^2$, e.g., 0.3 g/in$^2$.

Figure 3A:
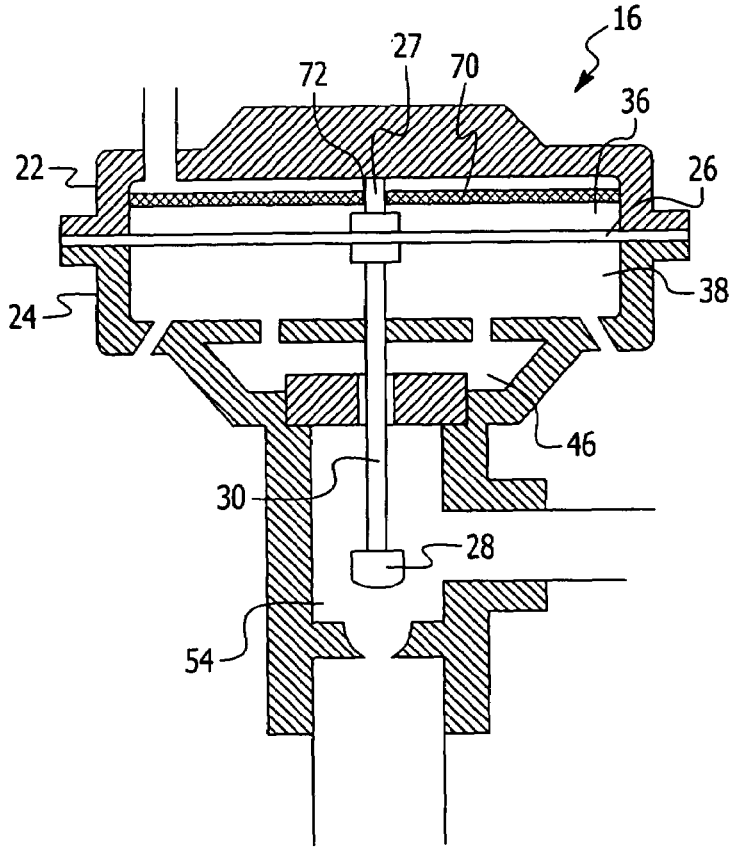
FIG. 3A is an enlarged cross-sectional view of the EGR valve in an alternative embodiment of the present invention.
Figure 3B:
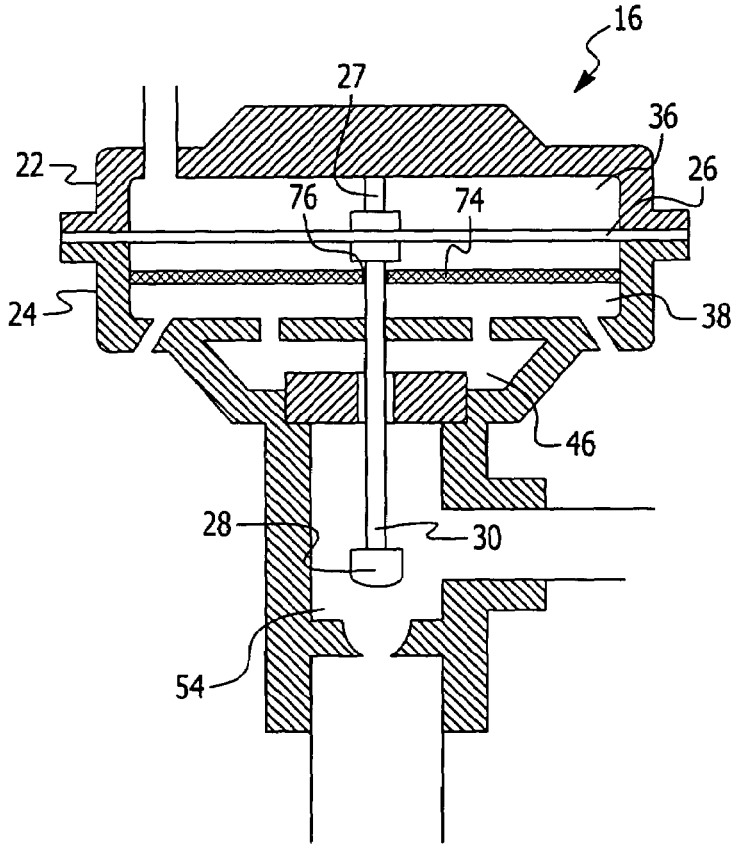
FIG. 3B is an enlarged cross-sectional view of the EGR valve in an alternative embodiment of the present invention.
Figure 4A:
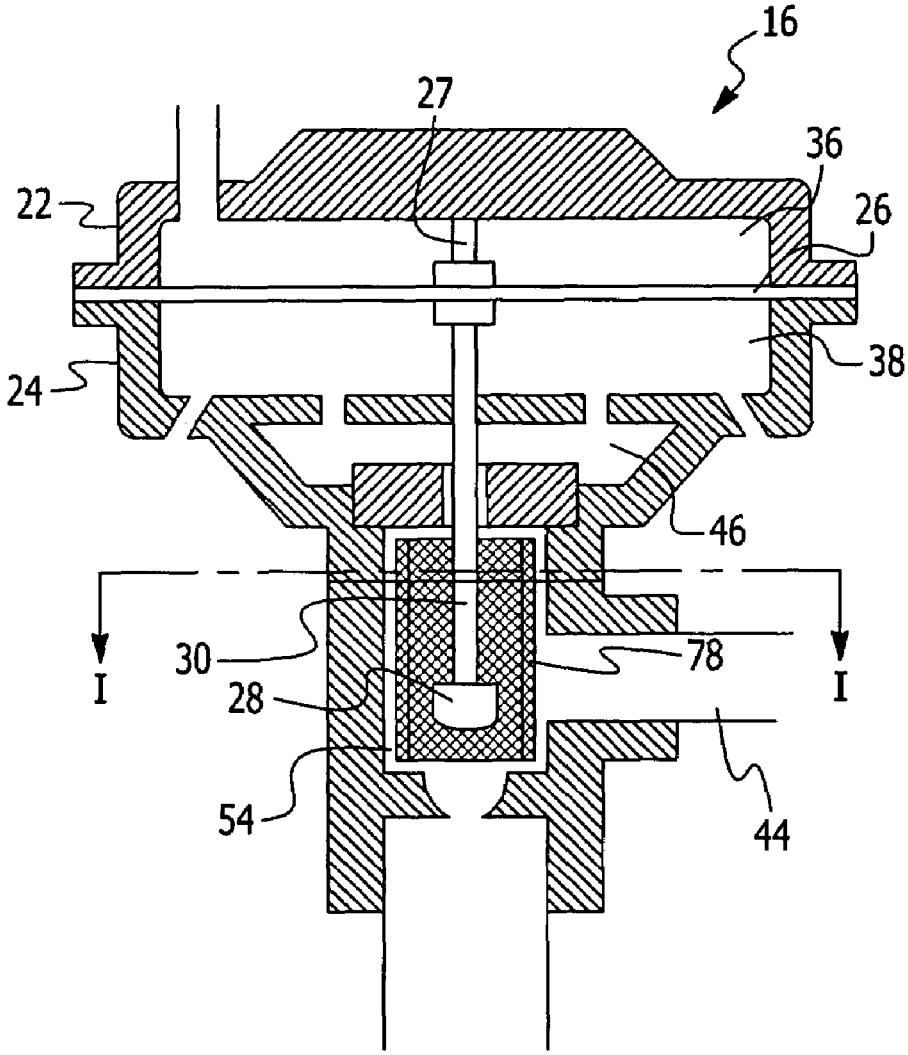
FIG. 4A is an enlarged cross-sectional view of the EGR valve in an alternative embodiment of the present invention.
Figure 4B:
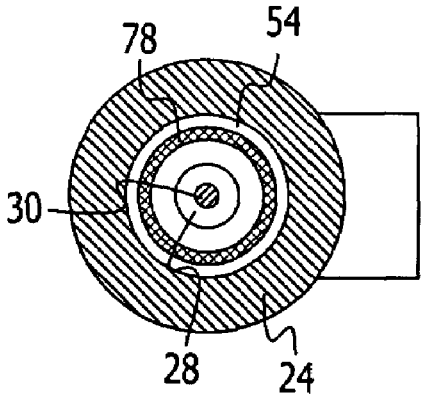
FIG. 4B is a vertical cross-sectional view of the EGR exhaust gas chamber portion of an EGR valve taken along line I-I of FIG. 4B.

Referring now to FIGS. 3A, 3B, 4A and 4B, an exhaust gas recirculation (EGR) valve 16 is illustrated containing a hydrocarbon coated substrate in one of three potential positions, which represent additional non-limiting embodiments of the present invention. FIGS. 3A, 3B and 4A all illustrate an EGR valve 16, as previously described, comprising an upper casing 22, or cap, and a lower casing 24, or body, aligned juxtaposed to each other. Together the upper 22 and lower 24 casings, respectively, define an interior chamber, which is divided by a diaphragm 26, arranged across the interior of the EGR valve 16, into an EGR upper chamber 36 and an EGR middle chamber 38. The lower casing 24 further defines an EGR lower chamber 46. An extended portion of the lower casing 24, defines an EGR exhaust gas chamber 54. In FIG. 3A, a hydrocarbon coated substrate 70, in accordance with the present invention, is shown placed within EGR upper chamber 36 and above diaphragm 26. The hydrocarbon coated substrate 70 contains an opening 72 to accommodate spring 27 connected to the upper surface of the diaphragm 26. In FIG. 3B a hydrocarbon coated substrate 74 is shown placed within EGR middle chamber 38. The hydrocarbon coated substrate contains an opening 76 to accommodate the valve stem 30. In FIGS. 4A and 4B a cylindrical shaped or coiled hydrocarbon coated substrate 78 is shown placed within the EGR exhaust gas chamber 54. As shown in FIG. 4B, the cylindrical shaped or coiled hydrocarbon coated substrate 78 can be placed or coiled within the interior of the EGR exhaust gas chamber 54, located between the interior wall of the lower casing 24 and the valve member 28 and valve stem 30.

The hydrocarbon adsorbent may be silica gel, a molecular sieve, activated carbon or mixture thereof. The material may be disposed within the housing as a single layer or separate layers of silica gel, a molecular sieve or activated carbon. Preferably, the material comprises a molecular sieve alone or in admixture with about 5 to about 50 weight percent of an activated carbon having a pore size of about 5 to about 500 angstroms. In a particularly preferred embodiment, the hydrocarbon adsorbent material of the present invention is a zeolite-based hydrocarbon adsorption coating.

The zeolite-based hydrocarbon adsorption coating of the present invention comprises one or more zeolite hydrocarbon adsorbents and a binder. The adsorbent material may include any known natural or synthetic zeolite such as faujasite, chabazite, clinoptilolite, mordenite, silicalite, zeolite X, zeolite Y, ultrastable zeolite Y, ZSM zeolite, offretite, or a beta zeolite. Preferred zeolites include ZSM, Y and beta zeolites. The particularly preferred adsorbent comprises a beta zeolite of the type disclosed in U.S. Pat. No. 6,171,556 incorporated herein by reference in its entirety.

A preferred zeolite-based adsorbent material is a zeolite having a high silica to alumina ratio. Generally, sieve materials having so-called three dimensional pore configurations are preferred over sieve materials having one- or two-dimensional pore configurations, although some of the latter function acceptably well. Acceptable materials typically have a micropore diameter of from about 3 to 8 angstroms. The zeolites, preferably beta zeolites may have a silica/alumina molar ratio of from at least about 25/1, preferably at least about 50/1, with useful ranges of from about 25/1 to 1000/1, 50/1 to 500/1 as well as about 25/1 to 300/1, from about 100/1 to 250/1, or alternatively from about 35/1 to 180/1 is also exemplified. The preferred beta zeolites are ion-exchanged beta zeolites, such as H/beta zeolite and Fe/beta zeolite.

As previously mentioned, preferred zeolites may include ZSM, Y and beta zeolites, with beta zeolites particularly preferred. The preferred zeolites can be treated to reduce the number of acid sites. This can be accomplished by leaching the zeolite with an organic or inorganic acid. Preferred acids include strong inorganic acids, such as sulfuric acid, nitric acid, hydrochloric acid, phosphoric acid and the like, and carboxylic acids such as trifluoro acetic acid, and dicarboxylic acids such as oxalic, malonic, succinic, glutaric, adipic, maleic, fumaric, phthalic and the like. Useful acids preferably include polyacids, preferably difunctional acids, more preferably dicarboxylic acids with oxalic acid most preferred. The acid use is at a concentration of 0.02 to 12N, preferably 0.1 to 10N, and a solid zeolite concentration of 0.01 to 1.0 g/ml and preferably 0.05 to 0.5 g/ml. The leaching is conducted at a suitable temperature range, typically of from 10 to 100° C.; for example, preferably at 70 to 100° C. when using sulfuric acid and from 10 to 50° C. when using oxalic acid. The leaching is conducted for a sufficient time to achieve the desired silica to alumina ratio attainable at the leach conditions and concentrations, and is typically from about 0.5 to 5 hours, and preferably 0.5 to 3 hours.

The zeolite can be steam treated with steam at from 350 to 900° C. Preferably, the stream treatment is conducted at from 400 to 800° C., and more preferably 500 to 750° C. with a most preferred range being from 550 to 750° C. The steam temperature can be increased at a suitable rate such as from 100 to 600° C. per hour. A useful steam concentration is from 10 to 100% and preferably 30 to 100% with a preferred concentration at from about 50 to 100% with the balance being air. The steaming is preferably conducted at atmospheric pressure. The duration of the steam treatment is sufficient to treat the zeolite and is typically from 0.5 to 48 hours, preferably 0.5 to 24 hours, more preferably from 0.5 to 8 hours and most preferably 0.5 to 5 hours. The steam treatment is believed to reduce the acidity of the zeolite by removing at least some of the aluminum from the framework of the zeolite. Steam treated zeolites have been found to have an increased durability when used to adsorb hydrocarbons in gaseous streams and to resist coke formation. Preferably, the zeolite can be treated with both leaching and steam treatment. In a particularly preferred process, the zeolite is first acid leached followed by steam treatment. Optionally, the steps of steam treatment and steaming can be repeated in any desired order. For example, leached and steamed zeolite can be repeatedly leached followed by steaming. In a specific embodiment the zeolite can be leached, steamed and leached again.

A useful method to treat beta zeolite is disclosed, for example in CN 1059701A, published Mar. 25, 1992 and herein incorporated by reference. This reference discloses a high Si beta zeolite produced by calcining to remove nitrogen compounds from a beta zeolite made through an organoamine template process. Leaching the beta zeolite is accomplished with an organic or inorganic acid solution having a concentration of 0.02 to 12N, preferably 0.1 to 10N, and a solid zeolite concentration of 0.01 to 1.0 g/ml and preferably 0.05 to 0.5 g/ml at from 10 to 100° C. for 0.5 to 5 hours, and preferably 1 to 3 hours. The leaching is followed by treating the zeolite with steam at from 400 to 900° C. with the steam temperature increasing at from 100 to 600° C. per hour. A useful steam concentration is 100% at a system pressure of 50 to 500 KPa. The duration of the steam treatment is from 0.5 to 5 hours.

Of particular interest with regard to the present invention is the acidity, which is imparted by the alumina in the zeolite framework. It is believed that the high silica to alumina ratio attained by leaching is related to the acidity of the zeolite. The acidity of the zeolite is believed to affect the durability of the zeolite when used to adsorb hydrocarbons from exhaust streams such as automotive and industrial exhaust steams which are typically at temperatures in the range of from 300 to 800° C. and more typically from 350 to 600° C. The zeolite, when used in such environments tends to lose adsorption efficiency due primarily to clogging of the pores and/or collapse of the zeolite framework. Maintenance of the stable zeolite framework can be attained by controlling the conditions under which the zeolite is treated. Such conditions include acid concentrations, steam temperatures and the like. Milder conditions reduce the tendency for the zeolite framework to deteriorate during treatment and permit the framework to be stabilized at the location where the alumina was removed.

Additionally, it is believed that steam treatment removes aluminum from the zeolite framework. The affected aluminum continues to reside in the zeolite, probably in the pores. The zeolite framework is believed to stabilize without the aluminum and the aluminum ions in the pores becomes alumina. The remaining alumina in the pores is not believed to contribute to the acidity of the zeolite which is reduced. The alumina in the pores can remain or be washed or leached out in a subsequent leaching step.

The zeolite, non-steamed or steamed, has been found to have improved coking resistance, i.e., the formation of coke during engine testing has been significantly reduced. While acid leaching methods to increase the silica to alumina ratio of a zeolite are known to decrease acidity, such methods are believed to remove aluminum atoms from zeolite particles indiscriminately. Methods such as steaming remove the aluminum from the framework of the zeolite preferentially at the Bronsted acid sites. The importance of this can be recognized by both more effective resistance to coking and by the knowledge of how to treat a zeolite to attain such performance with minimizing deterioration of the framework. In essence, leaching a zeolite to death will result in reduced Bronsted acidity; but using a method such as steam treatment alone, or more preferably balanced with leaching results in a more durable zeolite for use as a hydrocarbon adsorber in accordance with the present invention.

In one embodiment, an exhaust gas recirculation surface in accordance with the present invention can be coated with an undercoat high-surface area component, said component comprising a pre-treatment metallic thermal arc sprayed layer and optionally a washcoat layer, such as aluminum oxide, cerium oxide, and zirconium oxide. The metallic thermal arc sprayed layer coating can be useful to facilitate the adhesion of the washcoat layer, as well as additional undercoat layers. The metallic thermal arc sprayed layer of the present invention can be applied with a thermal spraying processes in general, including plasma spraying, single wire plasma spraying, high velocity oxy-fuel spraying, combustion wire and/or powder spraying, electric arc spraying, etc.

In one aspect of the present invention, electric arc spraying, e.g., twin wire arc spraying, of a metal (which term, as used herein and in the claims, includes mixtures of metals, including without limitation, metal alloys, pseudoalloys, and other intermetallic combinations) onto a metallic monolith honeycomb support substrate yields a structure having unexpectedly superior utility as a substrate for a washcoat layer, e.g., a refractory metal oxide or zeolite-based hydrocarbon adsorbent washcoat slurry. Twin wire arc spraying (encompassed herein by the term "wire arc spraying" and by the broader term "electric arc spraying") is a known process, see e.g., U.S. Pat. No. 4,027,367, which is incorporated herein by reference. Briefly described, in the twin wire arc spray process, two feedstock wires act as two consumable electrodes. These wires are insulated from each other as they are fed to the spray nozzle of a spray gun in a fashion similar to wire flame guns. The wires meet in the center of a gas stream generated in the nozzle. An electric arc is initiated between the wires, and the current flowing through the wires causes their tips to melt. A compressed atomizing gas, usually air, is directed through the nozzle and across the arc zone, shearing off the molten droplets to form a spray that is propelled onto the substrate. Only metal wire feedstock can be used in an arc spray system because the feedstock must be conductive. The high particle temperatures created by the spray gun produce minute weld zones at the impact point on a metallic substrate. As a result, such electric arc spray coatings (sometimes referred to herein as "anchor layers") have good cohesive strength and a very good adhesive bond to the substrate.

Thermal arc sprayed layers of a variety of compositions can be deposited on surface of the exhaust gas recirculation system in accordance with the present invention by utilizing, without limitation, feedstocks of the following metals and metal mixtures: Al, Ni, Ni/Al, Ni/Cr, Ni/Cr/Al/Y, Co/Cr, Co/Cr/Al/Y, Co/Ni/Cr/Al/Y, Fe/Al, Fe/Cr, Fe/Cr/Al, Fe/Cr/Al/Y, Fe/Ni/Al, Fe/Ni/Cr, 300 and 400 series stainless steels, and, optionally, mixtures of one or more thereof. In one embodiment, the metallic thermal arc sprayed layer may comprise nickel and aluminum. The aluminum may comprise from about 3 to 10 percent, optionally from about 6 to 8 percent, of the combined weight of nickel and aluminum in the metallic thermal arc sprayed layer.

In another embodiment, the exhaust gas recirculation system surface can be precoated with a slurry of a high surface area refractory metal oxide, dried for about 0.5 to about 2 hours at about 90 to about 120° C. and thereafter calcined at about 450 to about 650° C. for 0.5 to about 2 hour High surface area refractory metal oxides are well known in the prior art. Typically, the refractory metal oxide will have a specific surface area of about 60 to about 300 $m^2/g$. Useful refractory metal oxides include aluminum oxide, cerium oxide, zirconium oxide, gamma-alumina, alumina, titania, zirconia and mixtures of alumina with one or more of titania, zirconia, ceria, baria and a silicate. Preferably, the refractory metal oxide comprises gamma-alumina.

Thereafter, the refractory metal oxide-coated surface is coated with a slurry of the desired adsorbent and dried (e.g., at about 105° C.). Alternatively, the refractory metal oxide-coated surface may be coated with separate slurries of the hydrocarbon adsorbent, such as silica gel, molecular sieve and/or activated carbon to create layers, with drying between each layer occurring as described above.

If desired, a further top coat layer of the high surface area refractory metal oxide may be applied on top of the adsorbent, thereafter drying as described above after the application of each layer.

The hydrocarbon adsorbent slurry, e.g., a zeolite-based slurry, will also include a binder that will cause the material to adhere to the exhaust gas recirculation system surface. Such a binder is also referred to as a washcoat binder. Washcoat binders typical for use in the formulation of slurries include, but are not restricted to, the following: organic polymers; sols of alumina, silica or zirconia; inorganic salts, organic salts and/or hydrolysis products of aluminum, silica or zirconium; hydroxides of aluminum, silica or zirconium; organic silicates that are hydrolyzable to silica; and mixtures thereof.

The preferred binder is an organic polymer used in amounts of from 0.5 to 20, preferably 2 to 10, percent by weight of binder based on the weight of the material. The organic polymer may be a thermosetting or thermoplastic polymer and may be plastic or elastomeric. The polymeric binder may contain suitable stabilizers and age resistors known in the polymeric art. Most preferred are thermosetting, elastomeric polymers introduced as a latex into the adsorbent composition, preferably as an aqueous slurry. Upon application of the composition and drying, the binder material fixes the hydrocarbon adsorbent particles to themselves and the substrate surface, and in some cases, can crosslink with itself to provide improved adhesion. This enhances the integrity of the coating, its adhesion to the substrate surface and provides structural stability under vibrations encountered in motor vehicles. The use of a binder enables the material to adhere to the substrate surface without the necessity of an undercoat layer. The binder may also comprise additives to improve water resistance and improve adhesion.

Useful organic polymer binder compositions include polyethylene, polypropylene, polyolefin copolymers, polyisoprene, polybutadiene, polybutadiene copolymers, chlorinated rubber, nitrile rubber, polychloroprene, ethylene-propylene-diene elastomers, polystyrene, polyacrylate, polymethacrylate, polyacrylonitrile, poly(vinyl esters), poly (vinyl halides), polyamides, cellulosic polymers, polyimides, acrylics, vinyl acrylics and styrene acrylics, polyvinyl alcohol, thermoplastic polyesters, thermosetting polyesters, poly(phenylene oxide), poly(phenylene sulfide), fluorinated polymers such as poly(tetrafluoroethylene) polyvinylidene fluoride, poly(vinylfluoride) and chloro/fluoro copolymers such as ethylene chlorotrifluoroethylene copolymer, polyamide, phenolic resins and epoxy resins, polyurethane, acrylic/styrene acrylic copolymer latex and silicone polymers. A particularly preferred polymeric binder is an acrylic/styrene acrylic copolymer latex.

It has been found that compatibility of the components of a slurry comprising a hydrocarbon adsorbent material and a polymeric binder, such as a latex emulsion, is important for maintaining slurry stability and uniformity. For the purpose of the present invention compatibility means that the binder and the hydrocarbon adsorbent material remain as a mixture of separate particles in the slurry. It is believed that when the polymeric binder is a latex emulsion and the emulsion and hydrocarbon adsorbent material have electrical charges which cause the emulsion and hydrocarbon adsorbent material to repel each other, the emulsion and hydrocarbon adsorbent material are compatible and the slurry is stable and has a uniform distribution of the hydrocarbon adsorbent material and the polymer latex in the liquid vehicle, e.g. aqueous fluid such as water. If the hydrocarbon adsorbent material and latex emulsion particles do not mutually repel each other, irreversible agglomeration of the latex on the hydrocarbon adsorbent material will occur. These materials are therefore incompatible and the latex comes out of the emulsion.

For those zeolites that generate a low pH mixture when dispersed in water, additional stabilization can be achieved by increasing the pH. This is important since organic latex binder emulsions commonly used in the art are anionically charged and therefore, typically have a pH greater than 7. Combining a high pH binder emulsion with a low pH zeolite slurry creates instability that often results in slurry coagulation. The pH of the slurry can be controlled depending on the acidity of the adsorbent material, with pH levels being from about 4 to about 10. A preferred range is from about 5 to about 8, more preferably from about 6 to about 7.5.

In another embodiment, it is preferred to use a dispersant in conjunction with the binder. The dispersant may be anionic, non-ionic or cationic and is typically utilized in an amount of about 0.1 to about 10 weight percent, based on the weight of the material. Not surprisingly, the specific choice of dispersant is important. Suitable dispersants may include polyacrylates, alkoxylates, carboxylates, phosphate esters, sulfonates, taurates, sulfosuccinates, stearates, laureates, amines, amides, imidazolines, sodium dodecylbenzene sulfonate, sodium dioctyl sulfosuccinate and mixtures thereof. In one embodiment, a preferred dispersant is a low molecular weight polyacrylic acid in which many of the protons on the acid are replaced with sodium. In a particularly preferred embodiment, low molecular weight anionic dispersants such as sodium dodecylbenzene sulfonate and sodium dioctyl sulfosuccinate have been found to provide excellent zeolite dispersion and zeolite-binder stability. For example, in the case of slurry formulated with high Si/Al ratio SAL-Beta zeolite (i.e., sulfuric acid leached beta zeolite) and styrene-acrylic latex binder emulsion, low molecular weight anionic dispersants have been found to provide excellent zeolite dispersion and zeolite-binder stability. A preferred composition comprises about 90 weight percent beta zeolite, about 9 weight percent acrylic polymer latex and about 1 weight percent sodium dodecylbenzene sulfonate or sodium dioctyl sulfosuccinate.

While increasing the slurry pH or adding anionic dispersant alone may provide enough stabilization for the slurry mixture, best results may be obtained when both an increased pH and an anionic dispersant are used. For example, for zeolite-based slurries that generate a low pH when dispersed in water and/or a dispersant, additional stabilization can be achieved by increasing the pH, as described above.

The hydrocarbon adsorbent slurries of the present invention, particularly slurries containing polymer latexs, can contain conventional additives such as thickeners, biocides, antioxidants and the like. In one embodiment, a thickener such as a xanthan gum thickener or a carboxymethylcellulose thickener can be used. The thickener makes it possible to achieve a sufficient amount of coating (and hence sufficient hydrocarbon adsorption capacity) on relatively low surface area substrates. The thickener may also serve in a secondary role by increasing slurry stability by steric hinderence of the dispersed particles. It may also aid in the binding of the coating surface.

The improved hydrocarbon adsorbent slurry of the present invention can be applied to the exhaust gas recirculation surface by any known means in the art. For example, the slurry can be applied by spray coating, powder coating, or brushing or dipping a surface into the slurry.

What is claimed is:

1. An EGR valve for use in a motor vehicle exhaust gas recirculation system for reducing hydrocarbon emissions from said motor vehicle, wherein one or more surfaces of said EGR valve are coated with a hydrocarbon adsorbent.

2. The EGR valve of claim 1, wherein said EGR valve comprises structure including an upper casing and a lower casing, said lower casing containing an extended portion extending therefrom, wherein said extended portion further comprises an exhaust inlet, an exhaust gas chamber, an exhaust outlet, a valve stem containing a valve member, and a valve seat capable of receiving said valve member, wherein said valve stem containing said valve member is movable within said exhaust gas chamber and wherein one or more surfaces of said EGR valve structure are coated with a hydrocarbon adsorbent.

3. The EGR valve of claim 2, wherein said EGR valve structure further comprises upper and middle chambers divided by a diaphragm, said diaphragm being attached to said valve stem to control the movement of said valve stem within said EGR valve and wherein one or more surfaces of said EGR valve structure are coated with a hydrocarbon adsorbent.

4. The EGR valve of claim 3, wherein said one or more surfaces are selected from the group consisting of upper or lower surfaces of said diaphragm, inner surfaces of said upper or middle chambers, inner surface of said exhaust chamber, inner surface of said exhaust inlet, inner surface of said exhaust outlet, outer surface of said valve stem, and outer surface of said valve stem.

5. The EGR valve of claim 1, wherein said hydrocarbon adsorbent is a hydrocarbon adsorbent washcoat slurry comprising:

a) one or more hydrocarbon adsorbents for the adsorption of evaporative hydrocarbons; and b) an organic polymer binder to improve the adhesion of said hydrocarbon adsorbent to said one or more surfaces of said EGR valve.

6. The EGR valve of claim 5, wherein said washcoat slurry further comprises an anionic dispersant selected from the group consisting of sodium dodecylbenzene sulfonate and sodium dioctyl sulfosuccinate to stabilize said slurry.

7. The EGR valve of claim 1, wherein said one or more surfaces of said EGR valve are coated with an undercoat metallic thermal arc sprayed layer selected from the group consisting of Al, Ni, Ni/Al, Ni/Cr, Ni/Cr/Al/Y, Co/Cr, Co/Cr/Al/Y, Co/Ni/Cr/Al/Y, Fe/Al, Fe/Cr, Fe/Cr/Al, Fe/Cr/Al/Y, Fe/Ni/Al, Fe/Ni/Cr, 300 and 400 series stainless steels, and mixtures thereof, and wherein said hydrocarbon adsorbent is coated on said undercoat metallic thermal arc sprayed layer.

8. The EGR valve of claim 7, wherein said metallic thermal arc sprayed layer is further coated with a high surface area refractory metal oxide selected from the group consisting of aluminum oxide, cerium oxide, zirconium oxide, gamma-alumina, alumina, titania, zirconia, ceria, baria, silicate and mixtures thereof, and wherein said hydrocarbon adsorbent is coated on said undercoat metallic thermal arc sprayed layer.

9. The EGR valve of claim 1, wherein said hydrocarbon adsorbent is selected from the group consisting of silica gel, a molecular sieve, activated carbon, and mixtures thereof.

10. The EGR valve of claim 9, wherein said molecular sieve is selected from the group consisting of faujasite, chabazite, clinoptilolite, mordenite, silicalite, zeolite X, zeolite Y, ultrastable zeolite Y, ZSM zeolite, offretite, and beta zeolite.

11. The EGR valve of claim 10, wherein said hydrocarbon adsorbent is beta zeolite.

12. An EGR valve for use in a motor vehicle exhaust gas recirculation system for reducing hydrocarbon emissions from said motor vehicle, wherein one or more surfaces of said EGR valve are coated with a hydrocarbon adsorbent washcoat slurry comprising:

a) one or more hydrocarbon adsorbents for the adsorption of evaporative hydrocarbons;

b) an organic polymer binder to improve the adhesion of the hydrocarbon adsorbent to said one or more surfaces of said EGR valve; and c) a slurry pH from about 5 to about 8 to stabilize said slurry.

13. The EGR valve of claim 12, wherein said hydrocarbon adsorbent washcoat slurry further comprises an anionic dispersant selected from the group consisting of sodium dodecylbenzene sulfonate and sodium dioctyl sulfosuccinate.

14. The EGR valve of claim 12, wherein said hydrocarbon adsorbent is selected from the group consisting of silica gel, a molecular sieve, activated carbon, and mixtures thereof.

15. The EGR valve of claim 14, wherein said molecular sieve is selected from the group consisting of faujasite, chabazite, clinoptilolite, mordenite, silicalite, zeolite X, zeolite Y, ultrastable zeolite Y, ZSM zeolite, offretite, and beta zeolite.

16. The EGR valve of claim 15, wherein said hydrocarbon adsorbent is beta zeolite.

17. An EGR valve for use in a motor vehicle exhaust gas recirculation system for reducing hydrocarbon emissions from said motor vehicle, wherein said EGR valve contains therein one or more substrates coated with a hydrocarbon adsorbent.

18. The EGR valve of claim 17, wherein said EGR valve comprises upper and middle chambers divided by a diaphragm and an exhaust gas chamber communicating with said middle chamber, wherein said upper chamber, middle chamber or said exhaust gas chamber contains therein one or more substrates coated with a hydrocarbon adsorbent.

19. The EGR valve of claim 17, wherein said substrate is a disk shaped screen contained in said upper or middle chambers.

20. The EGR valve of claim 17, wherein said substrate is a cylindrical shaped or coiled screen substrate contained within said exhaust gas chamber.

* * * * *